United States Patent [19]

Paquet

[11] 4,239,233

[45] Dec. 16, 1980

[54] FIREARM TRAINING DEVICE

[76] Inventor: Paul Paquet, 163 Fulton Rd., Mamaroneck, N.Y. 10543

[21] Appl. No.: 65,646

[22] Filed: Aug. 10, 1979

[51] Int. Cl.[3] ..... F41J 5/00

[52] U.S. Cl. ..... 273/383; 124/17; 273/1 R; 434/16

[58] Field of Search ..... 273/383, 1 R, 311, 384; 35/25

[56] References Cited

U.S. PATENT DOCUMENTS

| | | | |
|---|---|---|---|
| 2,957,693 | 10/1960 | Ross | 273/311 X |
| 3,065,963 | 11/1962 | Dean | 35/25 UX |
| 3,802,099 | 4/1974 | Mell et al. | 35/25 |

*Primary Examiner*—Anton O. Oechsle

*Attorney, Agent, or Firm*—Spellman, Joel & Pelton

[57] ABSTRACT

A firearm training device comprises a combat target mounted at one end of a frame, an adjustabe inclined slide and a slingshot mechanism mounted within the frame. When the device is activated, a heavy ball is rolled down the slide. If the user hits the target with wax bullets before the ball reaches the end of the slide, it releases a trigger mechanism which blocks the further progress of the ball down the slide. If the ball reaches the bottom of the slide, prior to the bullet striking the target, the ball activates a trigger mechanism which releases the slingshot mechanism propelling a projectile such as a rubber ball at the trainee with sufficient force to effectively punish him. The device thus gives added impetus to the trainee's efforts to fire quickly and accurately.

7 Claims, 3 Drawing Figures

FIREARM TRAINING DEVICE

BACKGROUND OF THE INVENTION

This invention relates to firearm training devices, and particularly to a firearm training device for firing hand guns at short range.

The prior art discloses various training devices such as U.S. Pat. No. 3,802,099 to Mell et al which illustrates a complex training apparatus comprising a combination of sensors, photographic projectors and the like to display targets. If the target is missed or not hit in time, the trainee can be subjected to psychedelic or psychologically disturbing sounds, light flashes, blasts of air and the like.

U.S. Pat. No. 3,561,761 to Klemma discloses an amusement device including a launching device to fire a retaliatory missile at the participant when the corresponding target is hit and to fire return volleys. Ensmann et al U.S. Pat. No. 3,891,216 shows a simulated gunfight game in which players are provided with opposing targets and pistols and if one player hits the oposition's target before his own target is hit, the opposer's weapon is disabled. Another variation of this concept is also shown in the pistol draw games disclosed in U.S. Pat. No. 3,008,712 to Kinopka and U.S. Pat. No. 2,942,882 to Kuenstler, Jr., et al.

Other patents of general interest in this general area include U.S. Pat. Nos. 3,423,848 to Ohlund, 3,870,305 to Harclerode, 3,558,132 to Miller and 3,802,098 to Sampson et al.

While the prior art discloses a number of firearm training devices, there are few patents which show target training devices wherein if the trainee is too slow or misses the proper target, some sort of psychological or physical punishment is inflicted. Furthermore, no devices exist wherein the particular punishment is as significant and psychologically unnerving as in the present invention and hence, effective in training. It is further noted that prior art devices comprise complex electronic or electromechanical arrangements which is located a predetermined short distance away to simulate an actual condition requiring fast close-range firing. A trigger mechanism is coupled to the target area so that the mechanism is activated if a bullet hits the target area before a heavy wooden ball reaches the triggering mechanism for the slingshot. The wooden ball is released on the slide to activate the target mechanism and if the ball reaches the bottom of the slide prior to the bullet striking the target, the ball activates a trigger mechanism which is coupled to the slingshot which releases a non-fatal projectile such as a rubber ball at the user with sufficient force to effectively punish him for not hitting the target within a predetermined time interval controlled by the angle of the slide.

Accordingly, an object of this invenion is to provide a new and improved firearm training device.

Another object of this invention is to provide a new and improved firearm training device for hand guns at short distances wherein the trainee is effectively punished for missing or not hitting the target within a specified time.

A more specific object of this invention is to provide a new and improved portable firearm training device for hand guns which is of a mechanical nature, extremely low in cost and effectively punishes the user for not hitting the target within a predetermined time thereby providing added impetus to the trainee's efforts.

BRIEF DESCRIPTION OF THE DRAWINGS

Other objects and advantages may be seen from the following detailed description when viewed in conjunction with the accompanying drawings wherein.

DETAILED DESCRIPTION OF THE INVENTION

Figure 1:
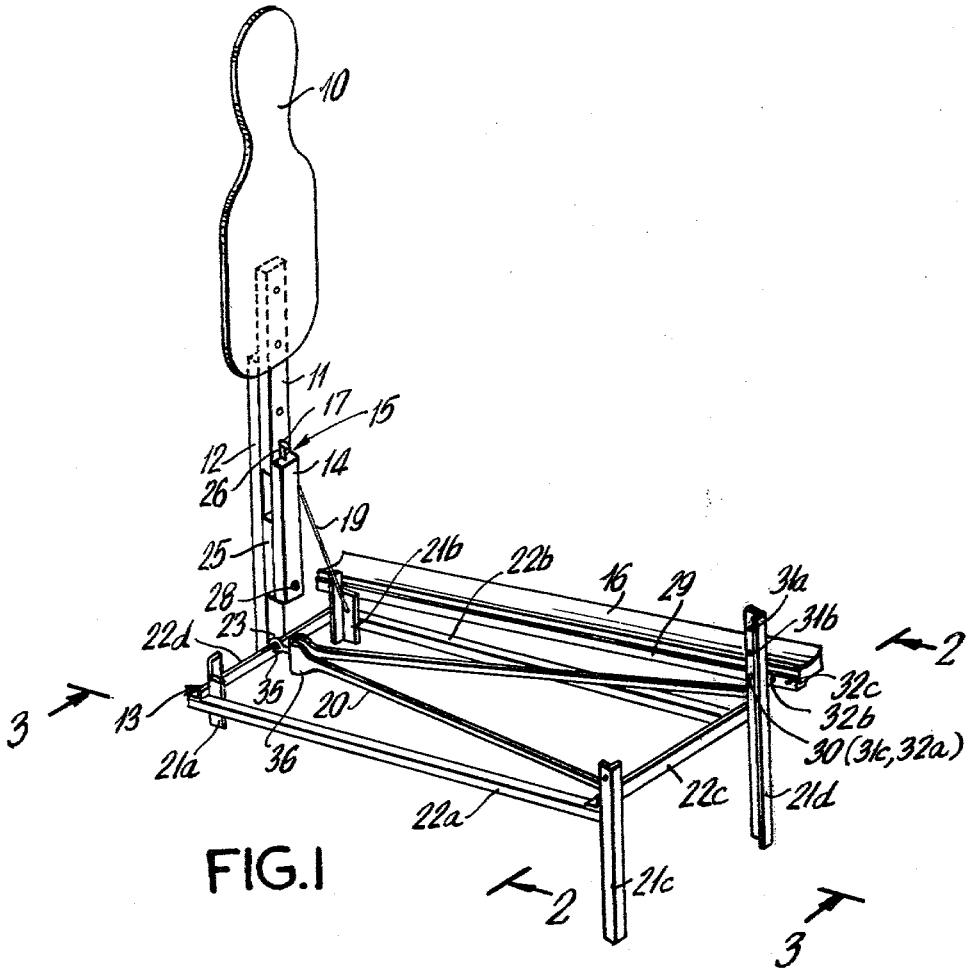
FIG. 1 is a perspective view of the firearm training device comprising the present invention, and, FIG. 2 is a view of the invention taken along lines 2—2 of FIG. 1, and, FIG. 3 is a view taken along the lines 3—3 of FIG. 1.
Figure 2:
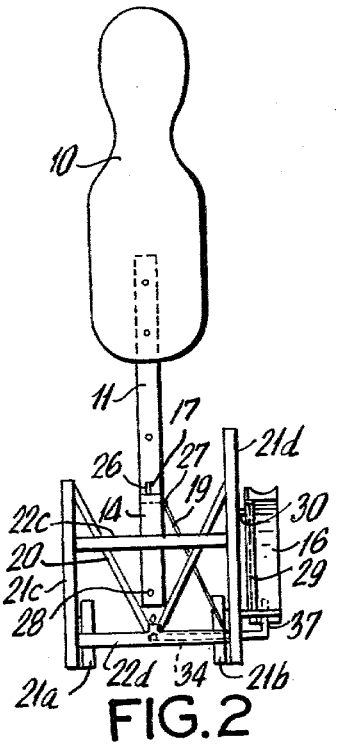
Figure 3:
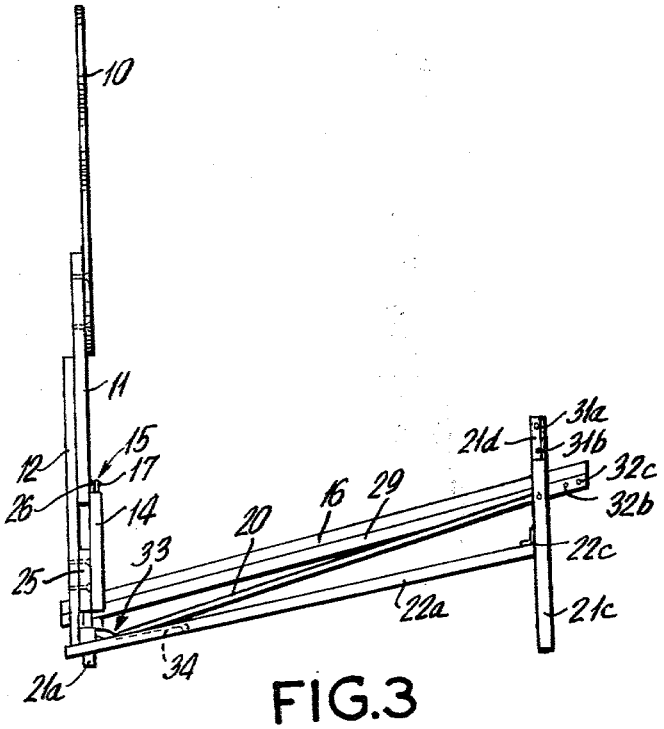

Referring now to FIG. 1 of the drawings, the firearm training device comprises a combat target 10 outlining the vital areas of the human body mounted on a vertical support member 11. The support member 11 is coupled to member 12 which extends upwardly from the frame 13. A vertical member 14 is pivotably connected to the lower portion of an intermediate member 25 which in turn is mounted to vertical member 12. In an unoperated condition, members 11, 12, 14 and 25 which may be rectangular wood pieces of similar width and thickness line up to present a single vertical image to the shooter.

The vertical member 14 forms a trigger mechanism 15 in cooperation with the slide 16 and the vertical support 11. The vertical support 11 includes a projecting member 17 which contacts the similar projecting member 26 at right angles on member 14 while in an unactivated condition. The member 14 is normally under tension from a line 19 extending from the frame portion near the slide 16 to the coupling 27 on the upper portion of the member 14. When the target 10 is hit by a wax or plastic bullet, the vertical support 11 is moved backwardly causing the projecting member 17 to become disengaged from the projecting member 26 and forcing the member 14 to pivot about the mounting means 28. The pivoting member 14 falls across the slide 16 to prevent the ball from activating the trigger means 23.

Thus, when the trigger mechanism 15 is activated by a wax bullet hitting the target 10, the member 14 pivots in a direction towards the slide 16 aided by the line 19 which may for example be a nylon rope. The trigger mechanism 15 effectively disables a catapult or slingshot 20 by blocking the triggering means 23 if the target is hit prior to activation of the slingshot.

The frame 13 comprises four leg members 21*a*, 21*b*, 21*c* and 21*d* and cross members 22*a*, 22*b*, 22*c* and 22*d* joining the aforementioned legs together. The legs 21*c* and 21*d* at the end opposite the target are of a longer length than the legs 21*a* and 22*b* at the target end of the device. The slide 16 is adjustably mounted to the frame 13 by means of an integral connecting member 29 which extends from leg 21*d* to leg 21*b*. The angle of the slide 16 may be changed by merely raising or lowering member 29 so that a bolt or other suitable means 30 may be inserted in corresponding apertures 31*a*, 31*b*, 31*c* in the leg 21*d* and 32*a*, 32*b* and 32*c* in the member 29.

The slide includes a trigger means 23 at the lower end thereof which is coupled to the slingshot 20. If a heavy ball (not shown) which is rolled down the slide, upon activation of the training device, reaches the trigger means 23, prior to the target 10 being hit, the slingshot 20 is released propelling a projectile at the trainee. The trigger means 23 comprises a shaped rod 33 having a base portion 34 extending along crossmember 22*d* to the vicinity of support 14 and having a hook 35 at that end to engage the enlarged portion 36 of the slingshot 20 while the other end comprises a vertical portion 37 extending upward at the end of the slide 16. When the ball contacts the vertical portion of the trigger 23, it pivots the rod 33 causing the hook 35 to become disengaged from the slingshot 20. The ball is retained in the slide 16 by the upwardly inclined stop 38 having a transverse lip 39.

The slingshot 20 is coupled to the respective legs 21*c* and 21*d* and to the hook 35 at the other end adjacent the target 10. A projectile such as a rubber ball is mounted in the slingshot to be propelled at the trainee with sufficient force to effectively punish him if he fails to hit the target in time. The force of the slingshot and the pain or tension which it inflicts, should be sufficient to unnerve the shooter so that his performance is improved. It is, of course, obvious that electronic timing means and trigger mechanisms could be substituted for mechanical means of the present invention.

While the invention has been explained by a detailed description of certain specific embodiments, it is understood that various modifications and substitutions can be made in any of them within the scope of the appended claims which are intended also to include equivalents of such embodiments.

What is claimed is:

1. A firearm training device comprising:

a frame having a plurality of spaced legs projecting upwardly and a crossmember extending between each adjacent leg to form a rigid structure, a target mounted to the crossmember at one end of the frame, an inclined slide mounted to the frame and extending downwardly from one leg thereof to a second leg, said second leg being mounted to the crossmember having the target thereon,, first trigger means coupled to the target crossmember and second trigger means mounted at the lower end of the slide to become actuated after a predetermined time interval, a slingshot coupled at its ends to a pair of spaced legs and, under tension, at an intermediate point to the second trigger means, a projectile positioned in the intermediate portion of the slingshot to be fired at a trainee, blocking means coupled to the target and pivotable against the slide upon actuation of the first trigger means to prevent the second trigger means from operating, whereby the first trigger means becomes actuated if the target is hit before the second trigger means becomes actuated thereby preventing the slingshot from operating due to the blocking means but if the second trigger means is actuated before the target is hit, the slingshot fires a projectile at the trainee, causing sufficient pain to influence the trainee's efforts.

2. A firearm training device in accordance with claim 1 wherein:

the frame comprises four spaced legs, the first two of said legs having the target crossmember therebetween and said legs being shorter than the second two legs, said second two legs being spaced at a predetermined target distance from the first two legs.

3. A firearm training device in accordance with claim 2 wherein:

one of the second two legs includes a plurality of spaced apertures on the uppoer portion thereof, the slide includes a plurality of apertures to mate with the apertures in the said leg to vary the angle of inclination of said slide, and, mounting means for joining corresponding apertures in the leg and slide.

4. A firearm training device in accordance with claim 1 further including:

a heavy ball which is released on the upper end of the slide to commence operation of the device and determine the time period for triggering the second trigger means.

5. A firearm training device in accordance with claim 1 wherein:

the target comprises a silhouette of vital body areas and includes mounting means extending downwardly therefrom which is affixed to the crossmember.

6. A firearm training device in accordance with claim 5 wherein:

the first trigger means comprises a first protruding member extending outwardly from the mounting means, said mounting means being moveable upon impact of the target, and a second protruding member extending upwardly from the blocking means to engage the first protruding member and further including resilient means extending between the slide and the blocking means wherein the trigger means becomes actuated upon an impact with the target, said first and second protruding members becoming disengaged.

7. A firearm training device in accordance with claim 5 wherein:

the second trigger means comprises a rod having a base portion extending along the target crossmember, a portion extending upwardly therefrom at the end of the slide to be operated if the blocking means is not activated and an end portion having a hook mounted, for coupling the slingshot thereto so that the slingshot is operated if the other end of the rod is engaged by a ball travelling down the slide.

* * * * *